US006672700B2

(12) United States Patent
Hosono et al.

(10) Patent No.: US 6,672,700 B2
(45) Date of Patent: Jan. 6, 2004

(54) INK JET RECORDING APPARATUS AND METHOD FOR DRIVING INK JET RECORDING HEAD INCORPORATED IN THE APPARATUS

(75) Inventors: Satoru Hosono, Nagano (JP); Kenji Otokita, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 226 days.

(21) Appl. No.: 09/910,835

(22) Filed: Jul. 24, 2001

(65) Prior Publication Data

US 2002/0018082 A1 Feb. 14, 2002

(30) Foreign Application Priority Data

Jul. 24, 2000 (JP) ..... 2000-222178
Jul. 11, 2001 (JP) ..... 2001-210155

(51) Int. Cl.[7] ..... B41J 29/393
(52) U.S. Cl. ..... 347/19
(58) Field of Search ..... 347/19, 15, 14, 347/23, 12, 5, 10, 11, 9, 16, 20, 43, 40, 41, 56, 63, 48, 17, 70; 358/298, 296

(56) References Cited

U.S. PATENT DOCUMENTS 6,331,040 B1 * 12/2001 Yonekubo et al. ..... 347/15

FOREIGN PATENT DOCUMENTS

| | | | |
|---|---|---|---|
| EP | 0 575 204 A2 | 12/1993 | |
| EP | 0 596 530 A2 | 5/1994 | |
| EP | 0 738 598 A2 | 10/1996 | |
| EP | 0 816 081 A2 | 1/1998 | |
| EP | 0 827 838 A2 | 3/1998 | |
| EP | 0 916 505 A1 | 5/1999 | |
| JP | 6-305134 A | 11/1994 | |
| JP | 8-207317 | 8/1996 | |
| JP | 9-1798 A | 1/1997 | |
| JP | 2000-1001 A | 1/2000 | |
| JP | 2000-94672 | 4/2000 | ..... B41J/2/045 |

* cited by examiner

*Primary Examiner*—Raquel Yvette Gordon
*Assistant Examiner*—Charles Stewart, Jr.
(74) *Attorney, Agent, or Firm*—Sughrue Mion, PLLC

(57) ABSTRACT

A recording head includes a nozzle orifice, a pressure chamber communicated with the nozzle orifice, and an actuator which varies a volume of the pressure chamber. A drive signal generator generates a drive signal in which a plurality of drive pulses are arranged within a unit recording period. The drive pulses includes at least a first drive pulse composed of an expanding element, which drives the actuator so as to expand the pressure chamber, an expansion holding element, which drives the actuator such that the expanded state of the pressure chamber is held in a first time period roughly equal to a first natural vibration period which is a natural vibration period of ink stored in the pressure chamber, and an ejecting element, which drives the actuator so as to contract the pressure chamber so that the ink in the pressure chamber is ejected from the nozzle orifice.

11 Claims, 7 Drawing Sheets

| GRADATION LEVEL | PS1 | PS2 | PS3 | PS4 | DECORDED VALUE |
|---|---|---|---|---|---|
| NO DOT (00) | O | × | × | × | 1000 |
| MICRO DOT (01) | × | O | × | × | 0100 |
| MEDIUM DOT (10) | × | × | O | O | 0011 |
| LARGE DOT (11) | × | O | O | O | 0111 |

INK JET RECORDING APPARATUS AND METHOD FOR DRIVING INK JET RECORDING HEAD INCORPORATED IN THE APPARATUS

BACKGROUND OF THE INVENTION

The present invention relates to an ink jet recording apparatus which records image, literature, etc. on a recording medium through the use of an ink jet recording head, and relates to a method for driving the ink jet recording head.

There is a recording apparatus using an ink jet recording head among recording apparatuses such as printer, plotter, and so on. Among the recording heads, there is a recording head ejecting ink drops from a nozzle orifice by varying ink pressure in a pressure chamber. The recording head varies ink pressure by varying capacity of the pressure chamber with deformation of piezoelectric vibrator, for example. Because of that, ink pressure is controlled by varying wave shape of pulse signal supplied to the piezoelectric vibrator so as to obtain desired ink quantity, jetting speed and so on.

The pulse signals are, for example, a micro dot pulse for recording a micro dot and a medium dot pulse for recording a medium dot. The medium dot pulse consists of: an expanding element raising a voltage from a reference voltage to an expansion voltage with constant gradient of degree not discharging the ink drops; an expansion holding element holding the expansion voltage for very short time (about 1.0 microseconds); and an ejecting element lowering the voltage from the expansion voltage to the reference voltage, for example. When the medium dot pulse is supplied to a piezoelectric vibration having a longitudinal vibration mode, pressure in the pressure chamber is decreased by slow expansion of the pressure chamber with the supply of the expanding element. After the expansion holding element is supplied instantly, the pressure chamber is contracted drastically by supply of the ejecting element, and ink pressure in the pressure chamber rises with the contract so that the designated quantity of ink drop corresponding to the medium dot is ejected from the nozzle orifice.

Incidentally, stability of discharge of ink drops is required in this kind of recording apparatus.

However, in the related middle pulse, vibration of meniscus just after supply of driving pulse becomes large because the ejecting element is supplied for very short time after the expanding element is supplied. Potential difference of the ejecting element (voltage difference from reference voltage to expansion voltage) tends to become relatively large, and even at this point, vibration of meniscus just after the supply becomes large. Because of that, continuous supply of driving pulses makes discharge of ink drops becomes unstable, for example, volume and flight direction of ink drops becomes uneven.

SUMMARY OF THE INVENTION

The invention is carried out in consideration of such the circumference, the object is to provide an ink jet recording apparatus making discharge of ink drops stable, and to provide a method for driving an ink jet recording head incorporated in the recording apparatus.

In order to achieve the above object, according to the present invention, there is provided an ink jet recording apparatus, comprising:

a recording head, including a nozzle orifice, a pressure chamber communicated with the nozzle orifice, and an actuator which varies a volume of the pressure chamber;

a drive signal generator, which generates a drive signal in which a plurality of drive pulses are arranged within a unit recording period, the drive pulses including at least a first drive pulse composed of:

an expanding element, which drives the actuator so as to expand the pressure chamber;

an expansion holding element, which drives the actuator such that the expanded state of the pressure chamber is held in a first time period roughly equal to a first natural vibration period which is a natural vibration period of ink stored in the pressure chamber; and an ejecting element, which drives the actuator so as to contract the pressure chamber so that the ink in the pressure chamber is ejected from the nozzle orifice; and a pulse supplier, which selects at least one drive pulse from the drive signal and supplies the selected drive pulse to the actuator.

In this configuration, since meniscus of the ink vibrates freely while the expansion holding element is supplied, the nozzle orifice is filled with the ink when the supply of the ejecting element is started so that the contraction of the pressure chamber is started from this state. Accordingly, ink ejection can be carded out substantially in a state which is so called "extruding ejection" so that the designated quantity of ink drops can be ejected even if driving voltage of the piezoelectric vibrator is made low considering that the nozzle orifice is filled with ink Therefore, required external force applied to the pressure chamber is decreased so that quantity and flight direction of ink drops are made stable.

Preferably, a second time period in which the expanding element is supplied is roughly equal to the first natural vibration period.

In this configuration, contraction of the actuator can be driven in synchronizing with expansion speed of the pressure chamber when the expanding element is supplied. Accordingly, since the pressure chamber is expanded efficiently, needless vibration of meniscus can be suppressed as low as possible.

Preferably, a third time period in which the ejecting element is supplied is roughly equal to a second natural vibration period which is a natural vibration period of the actuator.

In this configuration, the actuator can be driven surely without needless action such as bending etc. when the ejecting element is supplied. Thus, the pressure chamber in expanded state can be contracted surely.

Preferably, the first time period is set in a range of 80 to 120 % of the first natural vibration period.

Preferably, the selected drive pulse is determined in accordance with quantity of ink ejected from the nozzle orifice.

Here, it is preferable that the drive signal includes at least the first drive pulse which drives the actuator so as to eject first amount of ink and a second drive pulse which drives the actuator so as to eject second amount of ink which is different from the first ink amount Further, it is preferable that the second ink amount is less than the first ink amount.

It is preferable that the second drive pulse is arranged prior to the first drive pulse in the drive signal.

Alternatively, it is preferable that all the drive pulses in the drive signal are the first drive pulse.

According to the present invention, there is also provided a method of driving a recording head which includes a nozzle orifice, a pressure chamber communicated with the nozzle orifice, and an actuator associated with the pressure chamber, comprising the steps of:

driving the actuator so as to expand the pressure chamber so that meniscus of ink situated in the vicinity of the nozzle orifice is drawn toward the pressure chamber;

waiting until the drawn meniscus is returned in the vicinity of the nozzle orifice due to free vibration thereof; and driving the actuator so as to contract the pressure chamber so that the ink is ejected from the nozzle orifice after the waiting step is performed.

Preferably, a time period in which the waiting step is performed is roughly equal to a natural vibration period of ink stored in the pressure chamber.

BRIEF DESCRIPTION OF THE DRAWINGS

The above objects and advantages of the present invention will become more apparent by showing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Explanations will be given below of embodiments of the present invention, with reference to the accompanying drawings. Here, FIG. 1 shows an ink jet printer 1 (called simply "printer 1" hereafter) being an ink jet recording apparatus.

Figure 1:
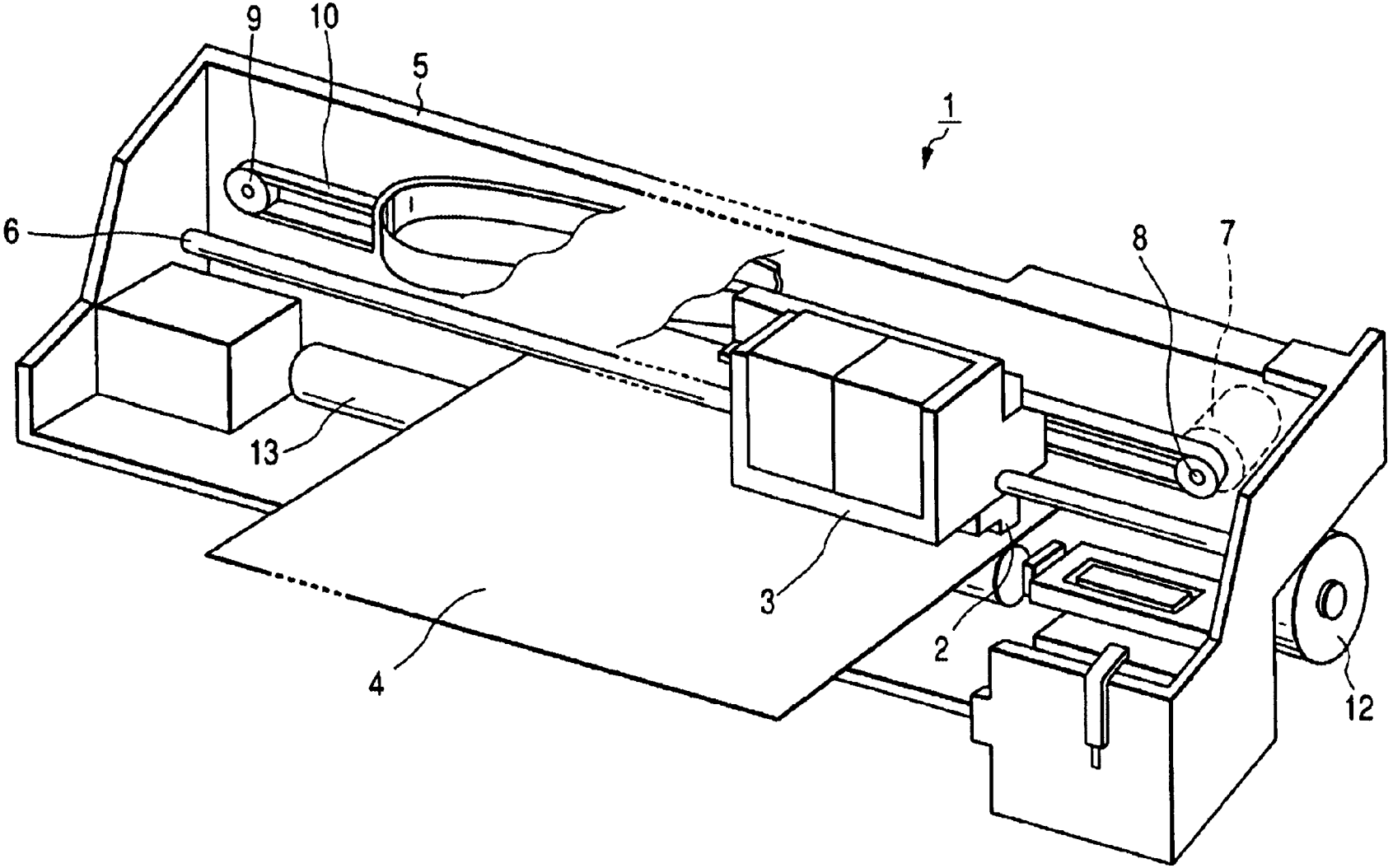
FIG. 1 is a perspective view showing a structure of an ink jet printer according to the present invention.

As shown in FIG. 1, the printer 1 comprises a carriage 3 on which a recording head 2 is mounted, a head scanning mechanism moving the carriage 3 reciprocatingly along a main scanning direction, a paper feeding mechanism feeding recording paper 4 being a kind of printing recording medium to a feeding direction (a sub scanning direction). The head scanning mechanism is constructed by a guide member extending right and left directions of a housing 5, a pulse motor 7, a driving pulley 8 connected to a rotary shaft of the pulse motor and rotated by the pulse motor 7, a freely rotating pulley 9, a timing belt 10 installed between the driving pulley 8 and the freely rotating pulley 9, and a printer controller 11 (see FIG. 2) controlling rotation of the pulse motor 7. The paper feeding mechanism is constructed by a paper feeding motor 12, a paper feeding roller 13 rotated by the paper feeding motor 12, and the printer controller so as to feed the recording paper 4 being interlocked by recording operation.

Figure 3:
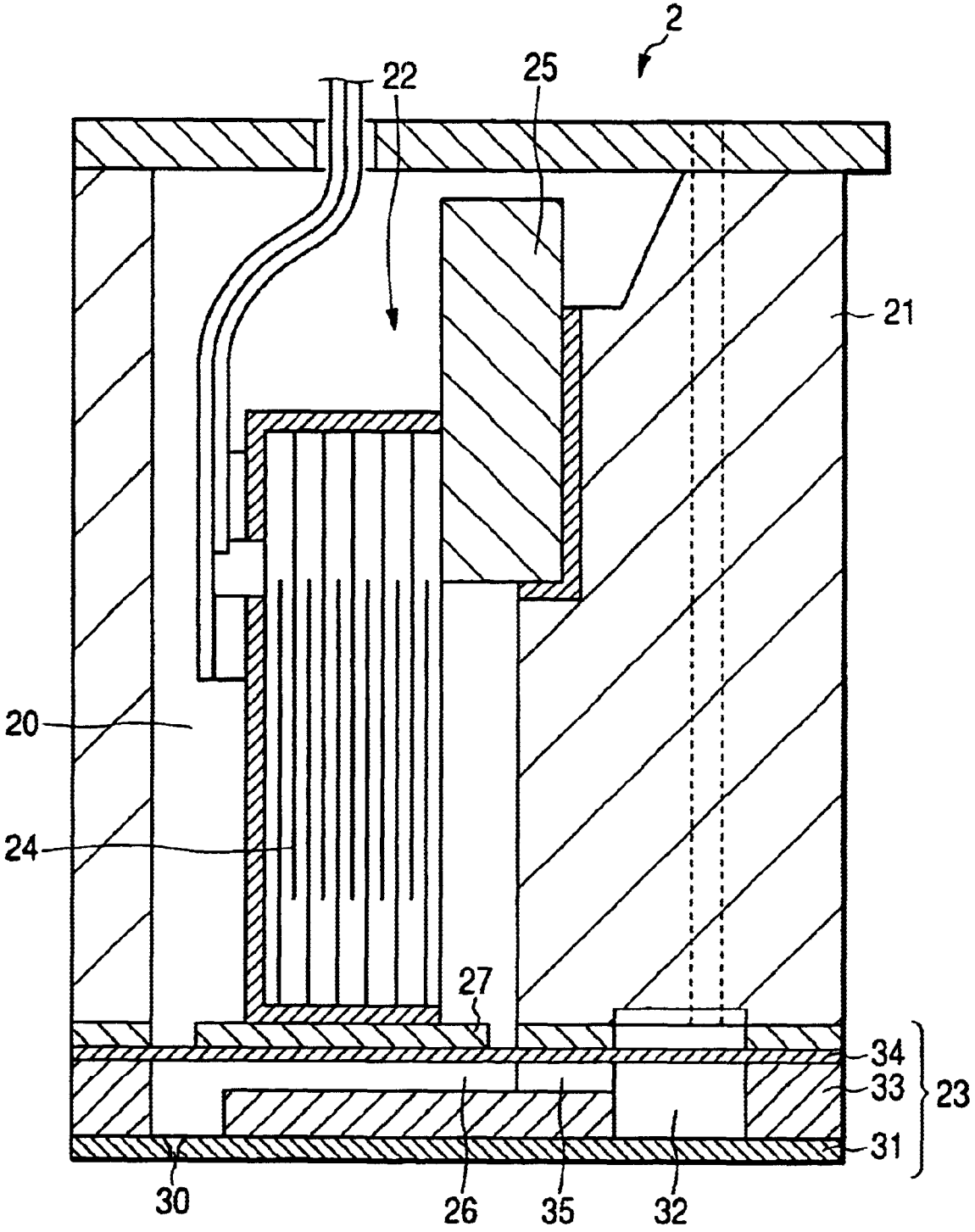
FIG. 3 is a sectional view showing a construction of a recording head.

The above-mentioned recording head 2 is constructed by a box-shaped case 21 forming an accommodation chamber 20 therein, a vibrator unit 22 fixed in the accommodation chamber 20, and a flow channel unit 23 joined to the tip face of the case 21 as shown in FIG. 3. The vibrator unit 22 joins a comb-teeth shaped piezoelectric vibrator 24 on a fixation plate 25 in a cantilevered manner. A tip of a free end of the piezoelectric vibrator 24 joins an island portion 27 provided at opposite surface of vibrating plate to a pressure chamber 26. The flow channel unit 23 has a nozzle plate 31 having plural nozzle orifices 30 arranged in rows (96 orifices in a row in the embodiment), a flow channel forming plate 33 forming the pressure chamber 26 and a common ink reservoir 32, and a vibrating plate 34 sealing one side of an opening of the pressure chamber 26 and a common ink reservoir 32. The nozzle plate 31 is arranged at one side face of the flow channel forming plate 33, and the vibrating plate 34 is arranged at the other face side being opposite side to the nozzle plate 31, so both are joined.

The pressure chamber 26 and the common ink reservoir 32 are communicated through an ink supply port 35 Therefore, in the flow channel unit 23, plural series of individual ink flow channels from the common ink reservoir 32 to the nozzle orifices through the pressure chamber 26 are formed corresponding to the nozzle orifices.

In the above-mentioned recording head 2, the island portion 27 joined to the tip of the piezoelectric vibrator 24 is pressed to the nozzle plate 31 side by extending the free end of the piezoelectric vibrator 24 to the longitudinal direction thereof. Thus, peripheral part of the vibrating plate 34 is formed and the pressure chamber 26 is contracted so that ink in the pressure chamber 26 is compressed. By contracting the piezoelectric vibrator 24 of extended state, the vibrating plate 34 is returned by elasticity, deformed, and the pressure chamber 26 is expanded so that inside of the pressure chamber 26 is decreased in pressure. Thus, ink pressure in the pressure chamber 26 can be controlled by controlling expansion and contraction state of the piezoelectric vibrator 24. Because of that, in the recording head 2, ink drops can be ejected from the nozzle orifices 30 by controlling the ink pressure in the pressure chamber 26.

In such the recording head 2, a natural vibration period Tc of ink in the pressure chamber 26, a natural vibration period Ta of the piezoelectric vibrator 24, and the like can be obtained based on inertance showing weight of ink per unit length, compliance showing capacity change per unit pressure, resistance showing inner loss of ink, pressure generated by the piezoelectric vibrator 24, and an equivalent circuit determined by volume, speed, etc. of the piezoelectric vibrator 24, ink, etc. as parameter. In the recording head 2 of the embodiment, the natural vibration period Tc of ink is 8.4 microseconds and the natural vibration period Ta of the piezoelectric vibrator 24 is 4.5 microseconds.

When image, literature, etc. are recorded on the recording paper 4, the carriage 3 is moved reciprocally to main scanning direction, and ink drops are ejected from nozzle orifices 30 of the recording head 2 being interlocked with the moving. Being interlocked with the main scanning, the paper feed motor 12 moves the recording paper 4 to paper feeding direction by rotating the paper feeding roller 13.

Figure 2:
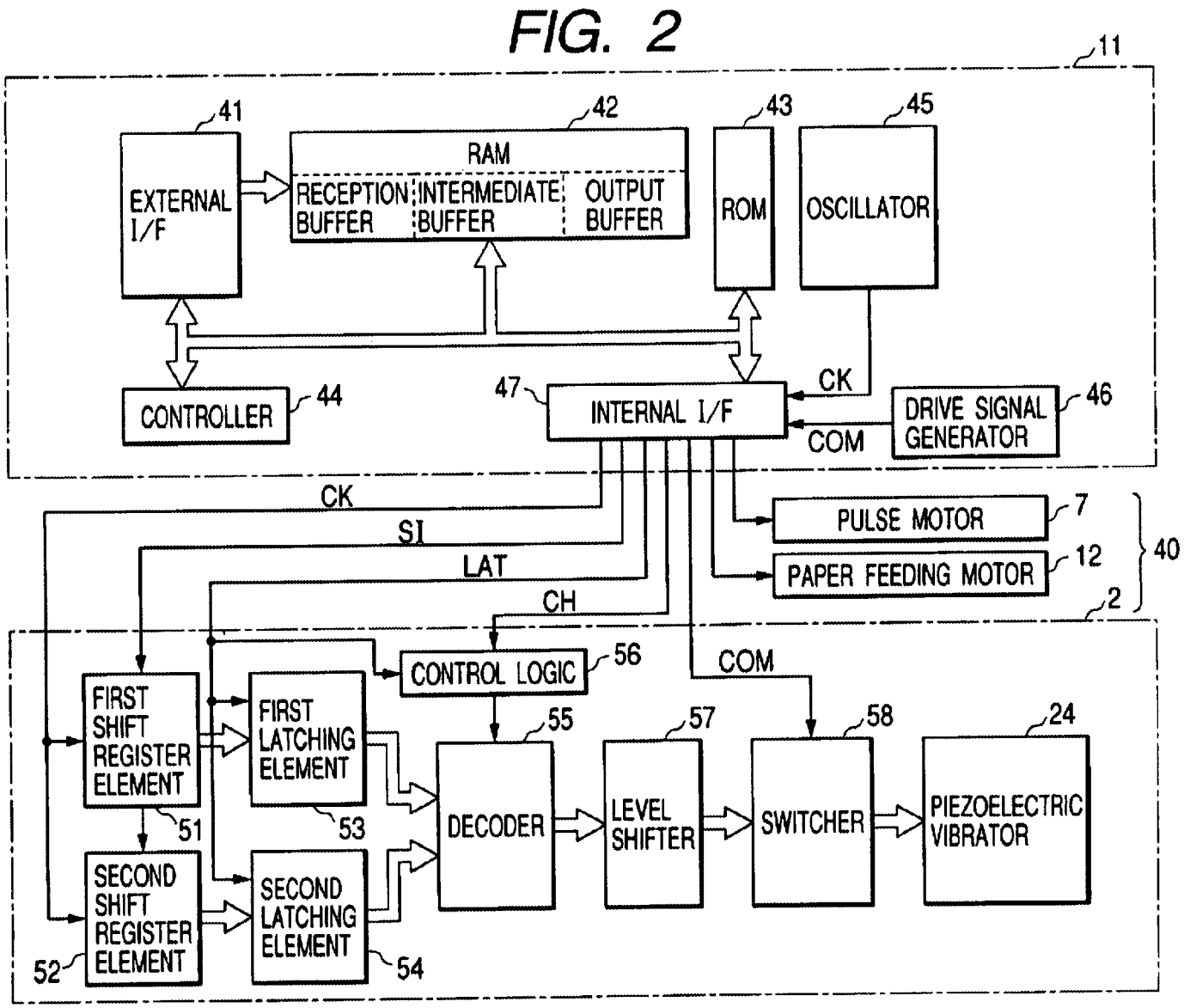
FIG. 2 is a block diagram showing an electrical configuration of a printer.

Next, an electrical configuration of the printer shown as example sill be described. As shown in FIG. 2, the printer 1 has the printer controller 11 and a print engine 40. The printer controller 11 has an interface 41 (called "external I/F" hereafter) receiving print data etc. from a host computer (not shown) and the like, a RAM 42 storing various kinds of data, a ROM 43 storing routine for process of the various kinds of data etc., a controller 44 consisting of a CPU and the like, an oscillator 45 generating clock signal (CK), a drive signal generator 46 generating a drive signal (COM) supplied to the recording head, and an interface 47 (called "internal I/F" hereafter) for transmitting dot pattern data, drive signal, etc. to the print engine 40.

Figure 4:
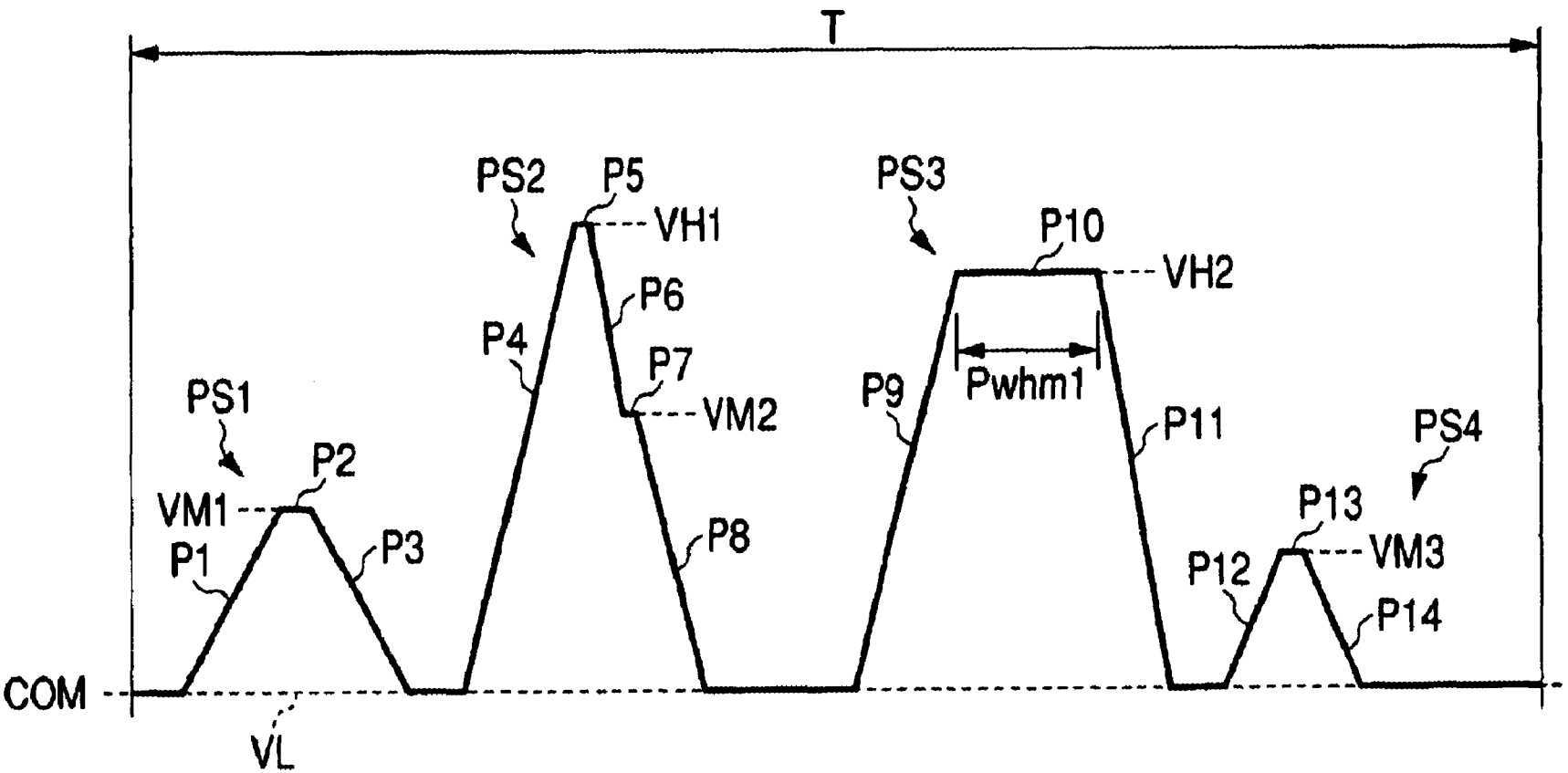
FIG. 4 is a diagram showing a drive signal.

The drive signal generator 46 generates a series of drive signal including plural pulses For example, as shown in FIG. 4, the drive signal generator 46 generates a drive signal COM Including a series of a vibrating pulse PS1, a micro dot pulse PS2, a medium dot pulse PS3, and a damping pulse PS4 in a unit recording period T. The drive signal will be described in detail later.

The external I/F 41 receives print data comprising any one data of character code, graphic function, and image data or plural data from the host computer. The external I/F 41 outputs busy signal (BUSY), acknowledge signal (ACK) to the host computer.

The RAM 42 is used for a reception buffer, an intermediate buffer, an output buffer, work memory (not shown). In the reception buffer, print data from the host computer that the external I/F 41 received is temporally stored. In the intermediate buffer, intermediate code data converted by the controller 44 is stored. In the output buffer, the intermediate code data is converted into dot pattern data, that is, gradation data of each dot The ROM 43 stores a various kinds of control routine, font data, and graphic function carried out by the controller 44 and a various kinds of procedures.

The controller 44 reads out print data in the reception buffer, converts the print data into intermediate code data, and stores the intermediate code data in the intermediate buffer. The controller 44 analyzes the intermediate code data read out from the intermediate buffer, and converts the intermediate code data into the gradation data of each dot referring font data, graphic function, etc stored in the ROM 43. The gradation data (SI) is consists of data of 2 bits for example.

The converted gradation data is stored in the output buffer, when gradation data associated with one line of the recording head 2 is obtained, the gradation data of the one line is transferred in serial to the recording head 2 through the internal I/F 47. When the gradation data of the one line is outputted from the output buffer, conversion to a next intermediate code data is carried out eliminating contents of the intermediate buffer. The controller 44 constitutes a part of a timing signal generator which supplies a latch signal (LAT) and a channel signal (CH) to the recording head 2 through the internal I/F 47. These latch signal and channel signal provides supply start timing of each pulse consisting of drive signal (COM).

The print engine 40 has an electric driving system of the recording head 2, the pulse motor 7, and the paper feeding motor 12.

The electric driving system of the recording head 2 has a shift resister section consisting of a first shift resister element 51 and a second shift resister element 52, a latching section consisting of a first latching element 53 and a second latching element 54, a decoder 55, a control logic 56, a level shifter 57, a switcher 58, and the piezoelectric vibrator 24. Plural shift resistor sections, latching sections, decoders, switchers, and piezoelectric vibrators are provided in association with the nozzle orifices 30.

The recording head 2 discharges ink drops based on the gradation data (SI) from the printer controller 11. That is, the gradation data (SI) from the printer controller 11 is transferred in serial from the internal I/F 47 to the first shift resister element 51 and the second shift resister element 52 synchronizing to clock signal (CK) from the oscillator 45. The gradation data (SI) from the printer controller 11 is 2 bits data of "10", "01", etc. for example, and is set at each dot, that is, at each nozzle orifice 30. Subordination bit (bit 0) concerning all nozzle orifices 30 is inputted to the first shift resister element 51, and superordination bit (bit 1) concerning all nozzle orifices 30 is inputted to the second shift resister element 52.

The first latching element 53 is connected electrically to the first shift resister element 51, and the second latching element 54 is connected electrically to the second shift resister element 52. When latch signal (LAT) from the printer controller 11 is inputted to each latching elements 53 and 54, the first latching element 53 latches data of subordination bit of gradation data, and the second latching element 54 latches data of superordination bit of gradation data. Each of groups of the first shift resister element 51 and the first latching element 53, and the second shift resister element 52 and the second latching element 54 constructs a memory to store temporally former gradation data input to the decoder 55.

The data latched at each latching elements 53 and 54 is inputted to the decoder 55. The decoder 55 generates print data of 4 bits translating gradation data of 2 bits. The decoder 55, the above-mentioned controller 44, the shift resisters 51 and 52, and the latching elements 53 and 54 serve as a recording data generator to generate recording data from gradation data.

Figures 7, 8:
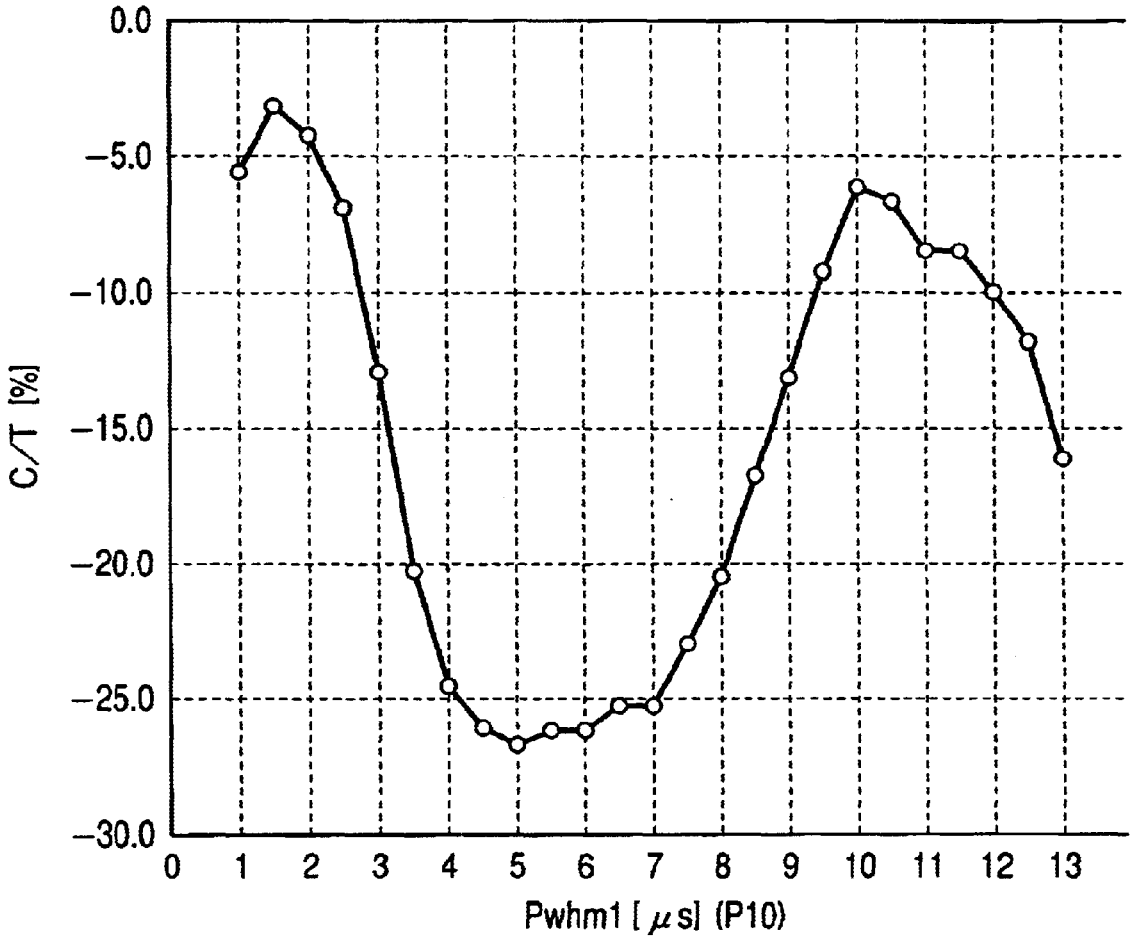
FIG. 7 is a chart showing a relation between crosstalk and supplying time of the fourth holding element.
FIG. 8 is a table showing a relation between pulses in the drive signal and recorded gradation levels.

Each bit of the recording data corresponds to each pulses PS1 to PS4 of drive signal and serves as selecting information of each pulse as shown in FIG. 8. To the decoder 55, timing signal from the control logic 56 is also inputted. The control logic 56 serves as the timing signal generator together with the controller 44.

The recording data translated by the decoder 55 is inputted to the level shifter 57 in order from superordination bit side with timing determined by timing signal. The level shifter 57 serves as a voltage amplifier, and outputs electrical signal amplified to voltage enough driving the switcher 58, for example, about several ten volts when recording data is "1".

The recording data of "1" amplified at the level shifter 57 is supplied to the switcher 58. To input side of the switcher 58, drive signal from the drive signal generator 46 is supplied, and to the output side of the switcher 58, the piezoelectric vibrator 24 is connected. The recording data controls operation of the switcher 58. While recording data input to the switcher 68 is "1" for example, drive signal is supplied to the piezoelectric vibrator 24, and the piezoelectric vibrator 24 deforms in response to the drive signal. On the other hand, since electric signal operating the switcher 58 is not outputted from the level shifter 57 while recording data input to the switcher 58 is "0". In short, pulse set with recording data "1" is supplied to the piezoelectric vibrator 24 selectively.

As known by the above discrimination, the controller 44, the shift resister elements 51 and 52, the latching elements 53 and 54, the decoder 55, the control logic 56, the level shifter 57, and the switcher 58 serve as a pulse supplier in the embodiment, needed pulse is selected from drive signal, and the selected pulse is supplied to the piezoelectric vibrator 24.

Next, drive signal (COM) generated by the drive signal generator 46 will be described. As shown in FIG. 4, drive signal is a signal including the vibrating pulse PS1, the micro dot pulse PS2, the medium dot pulse PS3, and the damping pulse PS4 within a unit recording period T. The drive signal generator 46 generates the vibrating pulse PS1 at initial timing in the recording period T, after that, generates the micro dot pulse PS2, the medium dot pulse PS3, and the damping pulse PS4 in order.

Here, the vibrating pulse PS1 is a pulse signal for stirring ink near the nozzle orifices 30, the micro dot pulse PS2 is a driving pulse for discharging very little ink drops recording a micro dot, for example, about 3.0 picoliters (pL, hereafter) from the nozzle orifices 30. The medium dot pulse PS3 is a driving pulse for discharging very little ink drops recording a medium dot (for example, ink drops of about 10 pL) from the nozzle orifices 30. The damping pulse PS4 is a pulse signal for shortly damping vibration of meniscus caused by supply of the medium dot pulse PS3.

The medium dot pulse PS3 corresponds to the first driving pulse of the invention, and the micro dot pulse PS2 corresponds to the second driving pulse of the invention. In the embodiment, relatively large volume of ink drops (ink drops of about 20 pL) corresponding to large dot are ejected as described later.

The vibrating pulse PS1 constructed by a trapezoid shaped pulse consisting of a first charging element P1 raising voltage from the lowest voltage VL near earth voltage to a vibrating voltage VM1 with constant gradient, a first holding element P2 holding the vibrating voltage VM1 for a certain time, and a first discharging element P3 dropping voltage from vibrating voltage VM1 to the lowest voltage VL with constant gradient. In the embodiment, vibrating voltage VM1 is set to voltage of 40% of the highest voltage VH1.

Thus, by supplying the vibrating pulse PS1 to the piezoelectric vibrator 24, the piezoelectric vibrator 24 slightly is contracted and is expanded to longitudinal direction thereof, the pressure chamber 26 is contracted after slow expansion. With the expansion and contract pressure change is occurred in the pressure chamber so that a meniscus of ink is vibrated slightly.

That is, when the first charging element P1 is supplied to the piezoelectric vibrator 24, the piezoelectric vibrator 24 is contracted slightly and the pressure chamber 26 is expanded slowly so as to decrease pressure therein. Next, when the first holding element P2 having the vibrating voltage VM1 is supplied, the expanded state of the pressure chamber 26 is held for a short time. After that, when the first discharging element P3 is supplied, the piezoelectric vibrator 24 is expanded slightly and the pressure chamber 26 is contracted slowly so as to increase pressure therein. As the result, ink in the pressure chamber 26 is comparably slowly compressed and decompressed so that the meniscus vibrates slightly.

The quantity of ink drops ejected by the micro dot pulse PS2 is less than that of the medium dot pulse PS3. The micro dot pulse PS2 consists of a second charging element P4 raising voltage from the lowest voltage VL to the highest voltage VH1 with relatively steep gradient, a second holding element P5 holding the highest voltage VH1 for very short time, a second discharging element P6 dropping voltage from the highest voltage VH1 to middle voltage VM2 with constant gradient, a third holding element P7 holding the middle voltage VM2 for very short time, and a third discharging element P8 falling voltage from the middle voltage VM2 to the lowest voltage VL with constant gradient. That is constructed by a pulse having two steps discharging portions.

In the embodiment, the middle voltage VM2 is set to voltage of 60% of the highest voltage VH1. Supplying time of the second charging element P4 is set based on the natural vibration period Tc of ink in the pressure chamber 26. Concretely, supplying time period of the second charging element P4 is set to 8.0 microseconds roughly equal to the natural vibration period Tc (8.4 microseconds) of ink.

By supplying such the micro dot pulse PS2 to the piezoelectric vibrator 24, meniscus is drawn to inner side of the pressure chamber 26 by supply of the second charging element P4. Using action of meniscus at drawing, very little ink drops corresponding to the micro dot are ejected.

That is, when the second charging element P4 is supplied to the piezoelectric vibrator 24, the piezoelectric vibrator 24 is contracted rapidly so that the pressure chamber 26 is expanded largely. With this, pressure of the pressure chamber 26 is largely decreased so that meniscus is largely drawn to the pressure chamber 26. At this time, the center part of the meniscus is drawn to the pressure chamber 26 side by large influence of decreased pressure of the pressure chamber 26, and is expanded to discharge direction by a reaction thereof. Therefore, the center part of the meniscus extends in column shape to the discharging direction. Subsequently, the second discharging element P6 is supplied so that the piezoelectric vibrator 24 extends. As the result, ink in the contracted pressure chamber 26 is compressed so that the ink column formed at center part of meniscus becomes a very small ink drop and separated to be ejected.

The medium dot pulse PS3 constructed by a trapezoid shaped pulse consisting of a third charging element P9 (corresponding to an expanding element of the invention) raising voltage from the lowest voltage VL to the second highest voltage VH2 with constant gradient, a fourth holding element P10 (corresponding to an expansion holding element of the invention) holding the second highest voltage VH2 for the designated time, and a fourth discharging element P11 (corresponding to an ejecting element of the invention) dropping voltage from the second highest voltage VH2 to the lowest voltage VL with constant gradient.

In the embodiment, supplying time periods of the third charging element P9 and the fourth holding element P10 are made roughly equal to the natural vibration period Tc of ink in the pressure chamber 26. Concretely, the supplying time period of the third charging time P9 is set to 8.0 microseconds and the supplying time period of the fourth holding element P10 is set to 10.0 microseconds. In other words, the supplying time period of each element is set within the range from 6.8 microseconds, 80% of the natural vibration period Tc (8.4 microseconds) of ink to 10.0 microseconds, 120% of the natural vibration period Tc. Supplying time period of the fourth discharge element P11 is set to 4.5 microseconds roughly equal to the natural vibration period Ta of the piezoelectric vibrator 24.

By supplying such the medium dot pulse P83 to the piezoelectric vibrator 24, the piezoelectric vibrator 24 is contracted by the third charging element P9 so that the pressure chamber 26 is expanded, and the expanded state of the pressure chamber 26 is held while supplying the fourth holding element P10. While this period, the meniscus is vibrated freely. After that, the piezoelectric vibrator 24 is extended by the fourth discharging element P11 so that the pressure chamber 26 is contracted, and an ink drop for recording a medium dot is ejected.

At this time, since the third charging element P9, the fourth holding element P10, and the fourth discharging element P11 consisting of the medium dot pulse PS3 are configured as mentioned the above, driving voltage for charging the designated quantity of ink drops (voltage from the second highest voltage VH2 to the lowest voltage VL, called "driving voltage VHM" hereafter) can be made lower. Moreover, it is possible to prevent generation of crosstalk and to improve the vibration characteristic of the piezoelectric vibrator so that ink drops are stably ejected. The reason will be described in detail later.

The damping pulse PS4 is constructed by a trapezoid shaped pulse consisting of a fourth charging element P12 raising voltage from the lowest voltage VL to damping voltage VM3 with constant gradient, the fifth holding element P13 holding the damping voltage VM3 for very short time, and the fifth discharging element P14 dropping voltage from the damping voltage VM3 to the lowest voltage VL. In the embodiment, the damping voltage VM3 is set to voltage of 30% of the highest voltage VH1.

By supplying such the damping pulse PS4 to the piezoelectric vibrator 24, vibration of meniscus caused by supply of the medium dot pulse P83 can be damped shortly.

That is, when a fourth charging element P12 is supplied to the piezoelectric vibrator 24, the pressure chamber 26 is expanded slowly so that pressure therein is decreased. After that, when a fifth discharging element P14 is supplied, the pressure chamber 26 is contracted slowly so that pressure therein is slightly increased. Then, supply timing of the damping pulse PS4 is determined as a timing enabling to apply vibration of reverse phase to the meniscus vibration caused by the medium dot pulse PS3. In other words, the timing is determined to timing enabling to remove residual vibration of the pressure chamber 26 after the discharge of ink drops corresponding to the medium dot. As the result, vibration of meniscus caused by discharge of ink drops corresponding to the medium dot is damped shortly.

Next, operation of the above-mentioned medium dot pulse will be described. The medium dot pulse PS3 is especially characterized in that the fourth holding element P10 is made roughly equal to the natural vibration period Tc of ink in the pressure chamber 26.

In the medium dot pulse PS3, the pressure chamber 26 is expanded by supply of the third charging element P9 being expanding element, the expanded state is kept by the fourth holding element P10 being expansion holding element, after that, the pressure chamber 26 is contracted by supplying the fourth discharging element P11 being discharging element so as to discharge ink drops.

In the series of operations, since the third charging element P9 is supplied to the piezoelectric vibrator 24 for 8.0 microseconds roughly equal to the natural vibration period Tc, contraction of the piezoelectric vibrator 24 can be synchronized with expansion speed of the pressure chamber 26 so that the pressure chamber 26 can be expanded efficiently. Thus, needless vibration of meniscus can be suppressed as low as possible. Since, the fourth discharging element P11 is set to 4.5 microsecond roughly equal to the natural vibration period Ta of the piezoelectric vibrator 24, the piezoelectric vibrator 24 can be surely extended without needless action such as bending. Thus, the pressure chamber 26 of expanded state can be surely contracted.

After the above-mentioned fourth holding element P10 is supplied for 10.0 microseconds roughly equal to the natural vibration period To, the fourth discharging element P11 is supplied. Here, supply start timing of the fourth discharging element P11 is timing that the meniscus drawn to the pressure chamber 26 side by decompressing the pressure chamber 26 returns again to edges of the nozzle orifices by free vibration: Because of that, contraction of the pressure chamber 26 starts from the state that the nozzle orifices are filled with ink, and discharge of ink drops is carried out at the state so called "extruding ejection". Therefore, the designated quantity of ink drops can be ejected even if the driving voltage VHM is made low in association with the amount of ink filled in the nozzle orifices 30. At this timing, ink drops can be jetted at suitable speed required for image recording.

Figure 5:
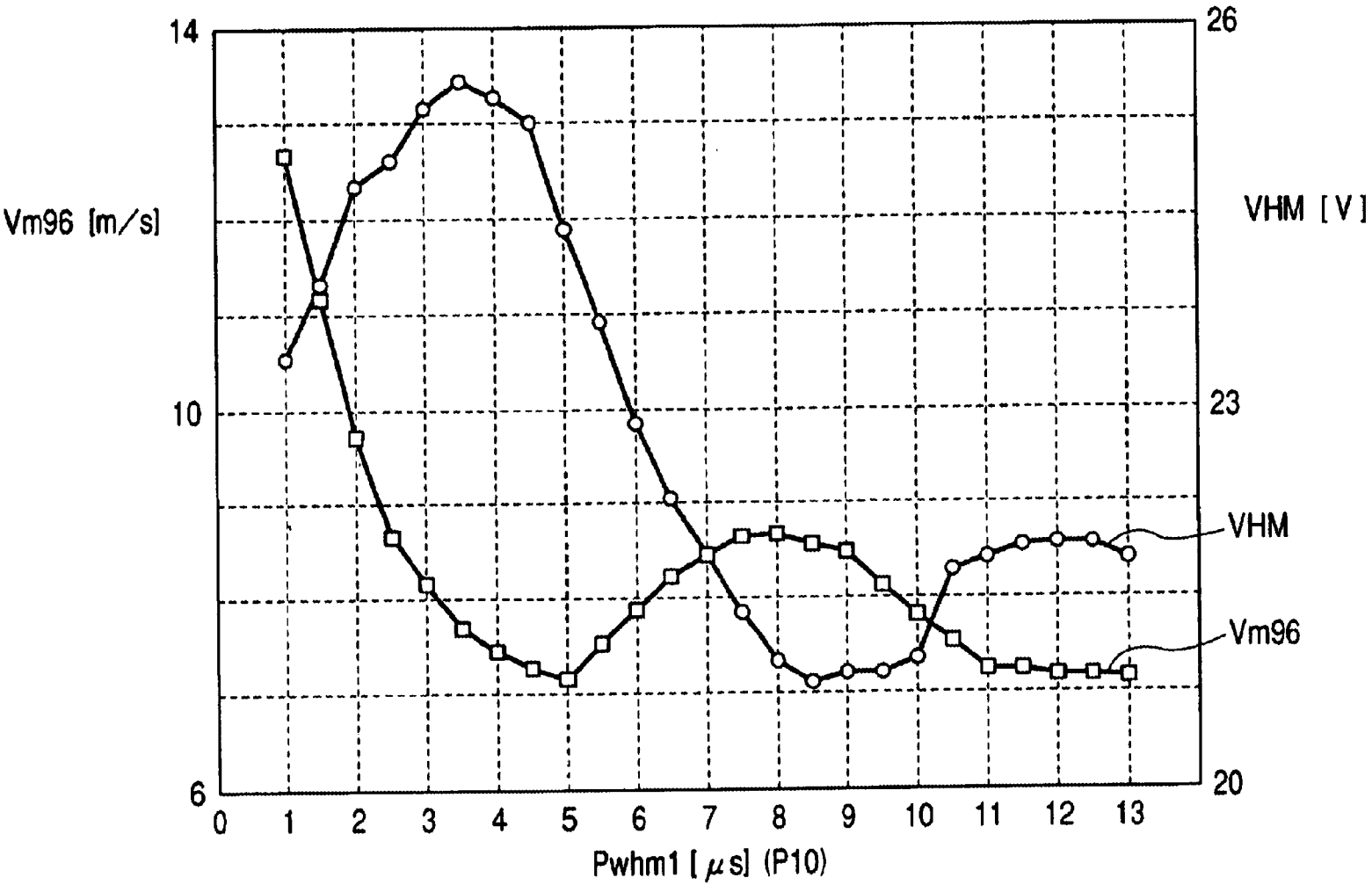
FIG. 5 is a chart showing a relation between driving voltage for discharging the designated quantity of ink drops and jetting speed of ink drops, and supplying time of a fourth holding element in the drive signal.

This will be described based on the graph of FIG. 5. In this figure, there are shown changes of required driving voltage VHM for ejecting ink drops of the medium dot (a line marked circle) and changes of jetting speed of ink drops (a line marked rectangle) at varying supplying time Pwhm1 of the fourth holding element P10. The jetting speed Vm96 means jetting speed when ink drops are ejected from all nozzle orifices 30 of 96 pieces.

As shown with the line marked circle, driving voltage VHM is 23.4 V when supplying time period Pwhm1 is 1.0 microseconds. The supplying time period Pwhm1 is longer, the driving voltage VHM becomes larger, when supplying time period Pwhm1 is 3.5 to 4.0 microseconds, driving voltage VHM becomes largest, 25.5 V. After that, the supplying time period Pwhm1 is longer, the driving voltage VHM becomes lower, when supplying time period Pwhm1 is 8.0 to 10.0 microseconds, driving voltage VHM becomes lowest, 21.0 V. Further, although driving voltage VHM again rises when the supplying time period Pwhm1 exceeds 10.0 microsecond, the peak is 22.0 V (11.5 to 12.5 microseconds) so lower than the maximum of driving voltage VHM.

As shown with the line marked rectangle, the jetting speed is the highest, 12.69 m/s when supplying time period Pwhm1 is 1.0 microseconds. The supplying time period Pwhm1 is longer, the jetting speed becomes slower, when supplying time period Pwhm1 is 5.0 microseconds, the jetting speed becomes the lowest, 7.17 m/s. After that, the supplying time period Pwhm1 is longer, the jetting speed becomes higher, when the supplying time period Pwhm1 is 7.5 to 8.0 microseconds, the jetting speed becomes 8.66 m/s. Further, after that, the supplying time period Pwhm1 is longer, the jetting speed becomes slower, the jetting speed is 7.82 m/s when the supplying time period Pwhm1 is at 10.0 microseconds. When the supplying time period Pwhm1 is at 11.0 to 13.0 microseconds, the jetting speed becomes about 7.20 m/s.

As is clear from the figure, the driving voltage VHM periodically increases and decreases corresponding to the supplying time period Pwhm1 of the fourth holding element P10, and the period roughly matches the natural vibration period Tc. From this, it is considered that the driving voltage VHM changes depending on the state of ink pressure after supply of the third charging element P9, that is, the state of meniscus Similarly, since jetting speed of ink drops tend to change periodically, it is also considered that the jetting speed changes depending on the state of meniscus. Then, the state of ink pressure after supply of the third charging element P9 is considered based on action of meniscus.

About driving voltage VHM for discharging the designated quantity of ink drops first, it is considered that the driving voltage changes corresponding to the position of meniscus at contract start of the pressure chamber 26. That is, at discharging the same quantity of ink drops, nearer position of meniscus to opening edges of nozzle orifices at contract start can make driving voltage VHM lower. When inside of the nozzle orifices is filled with ink, contraction force of the pressure chamber 26 acts directly to discharge of ink drops. Contrary, when inside of the nozzle orifices is not filled with ink, contraction force of the pressure chamber 26 must be used for moving of meniscus so that larger contraction is need.

About jetting speed of ink drops, it is considered that the jetting speed changes corresponding to tension of meniscus. That is, ejecting ink drops with high state in tension of meniscus makes jetting speed higher than ejecting ink drops with low state in tension of meniscus. This is the same reason as that a bow string drawn largely makes jetting speed of an arrow higher than the bow string drawn slightly.

When the fourth discharging element P11 is supplied at time 2.0 microseconds later after supply finish of the third charging element P9, that is, when supplying time period Pwhm1 of the fourth holding element P10 is set to 2.0 microseconds, jetting speed Vm of ink drops is 9.67 m/s, which is high, and required driving voltage VHM is 24.8 V, which is relatively high level in the range of the graph.

Figure 6A:
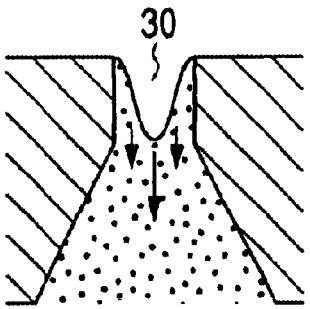
FIGS. 6A to 6G are model figures showing variation of meniscus with time when an ink drop is ejected.

From this, as shown in FIG. 6A, it is considered that meniscus is in the state in which the center portion thereof is largely drawn to the pressure chamber 26 side from opening face of the nozzle orifice 30; Therefore, when contraction of the pressure chamber 26 starts at this timing, the designated quantity of ink drops can not be ejected without setting the driving voltage VHM relatively large considering meniscus drawn. Since the tension of meniscus is high, jetting speed of ink drops is also high.

When the supplying time period Pwhm1 of the fourth holding element P10 is set to 3.0 microseconds, the jetting speed of ink drops is 8.15 m/s, which is slower than the case where the supplying time period Pwhm1 is 2.0 microseconds. On the other hand, required driving voltage VHM is 25.4 V, which is higher than the case where the supplying time period Pwhm1 is 2.0 microseconds.

Figure 6B:
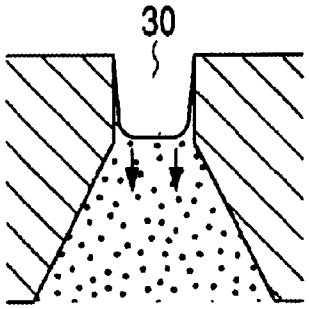

From this, as shown in FIG. 6B, peripheral part of meniscus catches up with center part, so it is considered that meniscus is largely drawn to the pressure chamber side. Therefore, when contraction of the pressure chamber 26 starts at this timing, the designated quantity of ink drops can not be ejected without setting the driving voltage VHM relatively large considering meniscus drawn. Since meniscus tends to change moving direction to discharging side, the tension decreases, and jetting speed of ink drops becomes lower than the case where supplying time period Pwhm1 is 2.0 microseconds.

When the supplying time period Pwhm1 of the fourth holding element P10 is set 4.0 to 5.0 microseconds, the jetting speed of ink drops is 7.47 m/s (at 4.0 microseconds) and 7.17 m/s (at 5.0 microseconds) which is slower than the case where the supplying time period Pwhm1 is 3.0 microsecond. On the other hand, the required driving voltage VHM is 25.4 V (at 4.0 microseconds) and 24.4 V (at 5.0 microseconds), which intends to decrease.

Figure 6C:
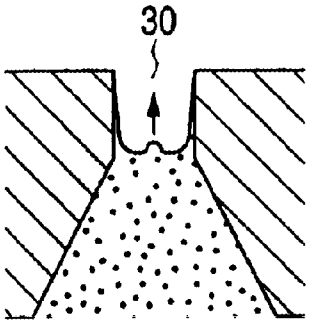
Figure 6D:
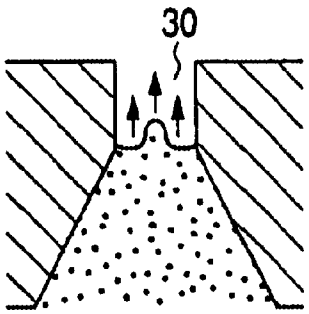

From this, as shown in FIGS. 6C and 6D, meniscus is still drawn largely, and it is considered that meniscus is in the state starting moving to discharging direction. Since center part of meniscus is easier to move than peripheral part, it is considered that center part slightly rises from periphery part as a reaction.

When the supplying time period Pwhm1 of the fourth holding element P10 is set 6.0 to 7.0 microseconds, the jetting speed of ink drops is 7.86 m/s (at 6.0 microseconds) and 8.48 m/s (at 7.0 microseconds) which is higher than the case where the supplying time period Pwhm1 is 5.0 microsecond. On the other hand, the required driving voltage VHM is 22.9 V (at 6.0 microseconds) and 21.8 V (at 7.0 microseconds) which further decreases than the case where the supplying time period Pwhm1 is 5.0 microseconds.

Figure 6E:
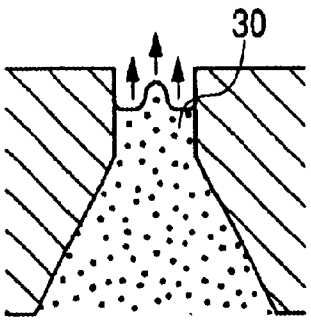
Figure 6F:
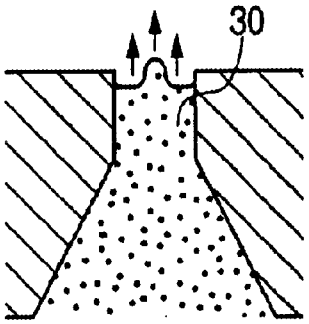

From this, as shown in FIGS. 6E and 6F, it is considered that the meniscus is moving to opening edge on the way of nozzle orifices.

When the supplying time period Pwhm1 of the fourth holding element P10 is set to 8.0 microsecond, which is roughly equal to the natural vibration period Tc, the jetting speed of ink drops is 8.66 m/s, which is slight higher than the case where the supplying time period Pwhm1 is 7.0 microsecond. On the other hands, the required driving voltage VHM is 21.0 V, which is further lower than the case where the supplying time period Pwhm1 is 7.0 microsecond.

Figure 6G:
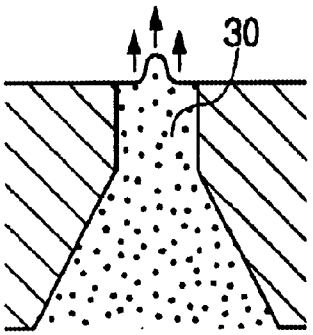

From this, as shown in FIG. 6G, it is considered that the drawn meniscus slightly rises to discharging side from opening edges of the nozzle orifices 30 by the free vibration. Therefore, when contraction of the pressure chamber 26 starts from this state, the designated quantity of ink drops can be ejected even if driving voltage VHM is set low as mentioned the above because ink is filled to opening edges of the nozzle orifices.

Further, in this case, meniscus is in the state rising to discharging side (outer side) rather than a steady state in which the meniscus is stable near the opening edges of the nozzle orifices. Because of that, the designated quantity of ink drops can be ejected more efficiently, that is, with lower driving voltage than the extruding ejection in which the pressure chamber 26 is contracted from the steady state.

When the supplying time period Pwhm1 of the fourth holding element P10 is set 9.0 to 10.0 microseconds, the jetting speed of ink drops is 8.48 m/s (at 9.0 microseconds) and 7.82 m/s (at 10.0 microseconds). On the other hand, the required driving voltage VHM is 20.9 V (at 9.0 microseconds) and 21.0 V (at 10.0 microseconds).

From this, as shown in FIG. 6G, it is considered that the meniscus is still in the state slightly rising to discharging side from edges of nozzle orifices 30. Meniscus is Changing its moving direction towards the pressure chamber side.

Therefore, even when the supplying time period Pwhm1 is 9.0 to 10.0 microseconds, the designated quantity of ink drops can be ejected even if driving voltage VHM is set low.

Although an elapsed time period after supply of the third charging element P9 is about 1.5 times of the natural vibration period To when the supplying time period Pwhm1 is set to 11.5 to 12.5 microseconds, drawn quantity of meniscus is less than the case where the supplying time period Pwhm1 is 3.5 to 4.0 microseconds because of attenuation of vibration. Therefore, when contraction of the pressure chamber 26 starts at this timing, the designated quantity of ink drops is ejected by setting driving voltage VHM somewhat larger than the case where the supplying time period Pwhm1 is 8.0 to 10.0 microseconds.

According to the embodiment, since the supplying time period Pwhm1 of the fourth holding element P10 of medium dot pulse PS3 is 10.0 microsecond, the required driving voltage VHM is only 21.0 V. Contrary with this, higher driving voltage VHM, 23.4 V is required in the related art in which the supplying time period of the expansion holding element of the medium dot pulse is 1.0 microseconds.

Since the required driving voltage VHM for discharging the designated quantity of ink drops can be made lower, the consumed power of the printer 1 can be saved. In addition, since external force applying to the pressure chamber 26 (the vibrating plate 34) is decreased, quantity and jetting direction of the ejected ink drops can be stabilized.

Since the supplying time period Pwhm1 of the fourth holding element P10 is set relatively long, 10.0 microseconds in the embodiment, ink drops can be ejected after vibration of the pressure chamber 26 caused by expansion subsides slightly. Even at this point, stable ejection of ink drops can be attained.

Further, the jetting speed of ink drops can be optimized. Generally, it is considered that jetting speed of ink drops has the optimum value. That is, it is considered that higher jetting speed makes flight direction and quantity of ink drops unstable, and that lower jetting speed makes landing point on the recording medium unstable. Considering these conditions, the optimum jetting speed of ink drops is considered about 8.0 m/s.

Since the supplying time period Pwhm1 of the fourth holding element P10 is 10.0 microseconds in the embodiment, the jetting speed is 7.82 m/s, and value near optimum value, 8.0 m/s, is obtained. Since, the supplying time period Pwhm1 of expansion holding element in the related medium dot pulse is 1.0 microseconds, the jetting speed is 12.69 m/s, which is considerably higher speed than optimum value, 8.0 m/s.

Still further, generation of crosstalk can be suppressed by making supplying time period Pwhm1 of the fourth holding element P10 roughly equal to the natural vibration period Tc. The crosstalk can be expressed with speed difference between jetting speed of ink drops ejected from one nozzle orifice and jetting speed of ink drops ejected from all nozzle orifices. That is, the larger the speed difference is, the larger the crosstalk is, and it is said discharge of ink drops is unstable.

Here, FIG. 7 is a view showing crosstalk at varying supplying time period Pwhm1 of the fourth holding element P10. Concretely, ratio of jetting speed at ejecting ink drops from all nozzle orifices is shown with C/T (%) as reference (100%) of jetting speed at ejecting ink drops from one nozzle orifice. For example, that C/T (%) is 0% in the figure means that jetting speed is the same at ejecting ink drops from one nozzle orifice and at ejecting ink drops from all nozzle orifices. That C/T (%) is −5% means that jetting speed is slower 5% at ejecting ink drops from all nozzle orifices than at ejecting ink drops from one nozzle orifice.

As shown in a line of FIG. 7, the C/T value at the supplying time period Pwhm1 of 1.0 microseconds is −5.7 % and the C/T value at the supplying time period Pwhm1 of 1.5 microseconds is −3.3 %, both show good value. The C/T value is the worst, more than −25.0 %, at range of the supplying time period Pwhm1 of 4.0 to 7.0 microseconds. When the supplying time period Pwhm1 is further longer, the C/T value is improved, −6.2 % at the supplying time period Pwhm1 of 10.0 microseconds. Further the supplying time period Pwhm1 is longer than 10.0 microseconds, the C/T value becomes worse again, −16.1% at the supplying time period Pwhm1 of 13.0 microseconds.

In medium dot pulse PS3 of the embodiment, the C/T value is −6.2% as the supplying time period Pwhm1 of the fourth holding element P10 is 10.0 microseconds. On the other hands, in the related medium dot pulse, the C/T value is −5.7% as the supplying time period Pwhm1 of expansion holding element is 1.0 microseconds. That is, about crosstalk, both of medium dot pulse of the embodiment and the related medium dot pulse can obtain good value.

The reason that generation of crosstalk is suppressed even if the supplying time period Pwhm1 of the fourth holding element P10 is made roughly equal to the natural vibration period Tc is considered. As shown with a line marked rectangle in FIG. 5, the jetting speed changes corresponding to length of the supplying time period Pwhm1 of the fourth holding element P10. Although the jetting speed differs at ejecting ink drops from one nozzle orifice and at ejecting ink drops from all nozzle orifices, it is considered that varying period of jetting speed too differs at ejecting ink drops from one nozzle orifice and at ejecting ink drops from all nozzle orifices. By making the supplying time period Pwhm1 of the fourth holding element P10 roughly equal to the natural vibration period Tc, speed difference between the Jetting speed at ejecting ink drops from one nozzle orifice and the jetting speed at ejecting ink drops from all nozzle orifices so as to suppress the generation of crosstalk.

Next, procedure for recording multi-gradation by selecting each pulse from the above-mentioned drive signal will be described referring to FIG. 8. In this embodiment, the case four gradation levels are realized: "no dot recording (gradation level 1)" in which meniscus is slightly vibrated without recording dot (that is, without ejecting ink drops), "micro dot recording (gradation level 2)" in which very small ink drops are ejected, "medium dot recording (gradation level 3)" in which small ink drops are ejected, and "large dot recording (gradation level 4)" in which relatively large ink drops are ejected.

In this case, each gradation level can be expressed with gradation data of 2 bits by using "00" for the gradation level 1, "01" for the gradation level 2, "10" for the gradation level 3, "11" for the gradation level 4. The pulse supplier (the controller 44, the shift resister elements 51 and 52, the latching elements 53 and 54, the decoder 55, the control logic S6, the level shifter 57, and the switcher 58) supplies each pulse PS1 to PS4 selectively to the piezoelectric vibrator 24 corresponding to quantity of ink drops ejected from the nozzle orifices 30.

At the gradation level 1, the vibrating pulse PS1 is supplied to the piezoelectric vibrator 24. That is, the gradation data "00" indicating the gradation level 1 is translated by the decoder 65 so that recording data "1000" of 4 bits is generated. By outputting data of each bit consisting of the recording data from the decoder 55 over generating period of the vibrating pulse PS1, the micro dot pulse PS2, the medium dot pulse PS3, and the damping pulse PS4 in order, the switcher 58 is made conductive for period of data "1". Thus, the vibrating pulse PS1 is selectively supplied from the drive signal to the piezoelectric vibrator 24 so that meniscus is vibrated slightly. As the result, ink near the nozzle orifices is stirred.

At the gradation level 2, the micro dot pulse P82 is supplied to the piezoelectric vibrator 24. That is, the gradation data "01" indicating the gradation level 2 is translated by the decoder 55 so that recording data "0100" of 4 bits is generated. These data of each bit is outputted from the decoder 55 over generating period of the vibrating pulse PS1 to the damping pulse PS4 in order. Thus, only the micro dot pulse PS2 is supplied selectively to the piezoelectric vibrator 24 from the drive signal so that very small ink drops are ejected from the nozzle orifices. As the result, small dots are recorded on the recording paper 4.

At the gradation level 3, the medium dot pulse PS3 and the damping pulse PS4 are supplied to the piezoelectric vibrator 24. That is, the gradation data "10" indicating the gradation level 3 is translated by the decoder 65 so that recording data "0011" of 4 bits is generated. These data of each bit is outputted from the decoder 55 over generating period of the vibrating pulse PS1 to the damping pulse PS4 in order. Thus, the medium dot pulse PS3 and the damping pulse PS4 are supplied selectively to the piezoelectric vibrator 24 from drive signal so that medium dots are recorded on the recording paper 4.

At the gradation level 4, the micro dot pulse PS2, the medium dot pulse PS3, and the damping pulse are supplied to the piezoelectric vibrator 24. That is, the gradation data "11" indicating the gradation level 4 is translated by the decoder 55 so that recording data "0111" of 4 bits is generated. These data of each bit is outputted from the decoder 55 over generating period of the vibrating pulse PS1 to the damping pulse PS4 in order. Thus, only the micro dot pulse PS2, the medium dot pulse PS3, and the damping pulse PS4 are supplied selectively to the piezoelectric vibrator 24 from the drive signal so that ink drops corresponding to the micro dot pulse PS2 and ink drops corresponding to the medium dot pulse PS3 are successively ejected from the nozzle orifices. As the result, large dots are recorded on the recording paper 4.

Since the supplying time period Pwhm1 of the fourth holding element P10 of medium dot pulse PS3 is set relatively long making roughly equal to the natural vibration period Tc in this case, the supplying time period Pwhm1 of the fourth holding element P10 can be used for damping time of vibration of meniscus caused by supply of micro dot pulse PS2. Thus, ink drops for recording medium dots can be ejected stably even if time from finishing generation of the micro dot pulse PS2 to starting generation of the medium dot pulse PS3 is made short Thus, the unit recording period can be made short so as to improve recording speed.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For example, the supplying time period Pwhm1 of the fourth holding element P10 may be made identical with the natural vibration period Tc, or may be n times (n is natural number 2 or more) of the natural vibration period Tc.

For the piezoelectric vibrator used for the recording head 2, a piezoelectric vibrator of bending vibration mode may be used instead of the piezoelectric vibrator 24 of longitudinal vibration mode.

Although the drive signal shown as an example includes driving pulse for ejecting plural kinds of ink drops different in quantity (the micro dot pulse PS2 and the medium dot pulse PS3) within the unit recording period T, the invention is not limited to this drive signal. For example, plural driving pulses included within the unit recording period T are constructed by plural medium dot pulses PS3 (the first driving pulse), and multiple gradation recording may be carried out by varying number of times of supplying the medium dot pulse PS3 to the piezoelectric vibrator 24.

What is claimed is:

1. An ink jet recording apparatus, comprising:

a recording head, including a nozzle orifice, a pressure chamber communicated with the nozzle orifice, and an actuator which varies a volume of the pressure chamber;

a drive signal generator, which generates a drive signal in which a plurality of drive pulses are arranged within a unit recording period, the drive pulses including at least a first drive pulse composed of:

an expanding element, which drives the actuator so as to expand the pressure chamber;

an expansion holding element, which drives the actuator such that the expanded state of the pressure chamber is held in a first time period roughly equal to a first natural vibration period which is a natural vibration period of ink stored in the pressure chamber; and an ejecting element, which drives the actuator so as to contract the pressure chamber so that the ink in the pressure chamber is ejected from the nozzle orifice; and a pulse supplier, which selects at least one drive pulse from the drive signal and supplies the selected drive pulse to the actuator, wherein the second time period in which the expanding element is supplied is approximately equal to the first natural vibration period.

2. The recording apparatus as set forth in claim 1, wherein a third time period in which the ejecting element is supplied is roughly equal to a second natural vibration period which is a natural vibration period of the actuator.

3. The recording apparatus as set forth in claim 1, wherein each of the first time period and the second time period is set in a range of 80 to 120% of the first natural vibration period.

4. The recording apparatus as set forth in claim 1, wherein the selected drive pulse is determined in accordance with quantity of ink ejected from the nozzle orifice.

5. The recording apparatus as set forth in claim 4, wherein the drive signal includes at least the first drive pulse which drives the actuator so as to eject first amount of ink and a second drive pulse which drives the actuator so as to eject second amount of ink which is different from the first ink amount.

6. The recording apparatus as set forth in claim 5, wherein the second ink amount is less than the first ink amount.

7. The recording apparatus as set forth in claim 5, wherein the second drive pulse is arranged prior to the first drive pulse in the drive signal.

8. The recording apparatus as set forth in claim 4, wherein all the drive pulses in the drive signal are the first drive pulse.

9. A method of driving a recording head which includes a nozzle orifice, a pressure chamber communicated with the nozzle orifice, and an actuator associated with the pressure chamber, comprising the steps of:

driving the actuator so as to expand the pressure chamber so that meniscus of ink situated in the vicinity of the nozzle orifice is drawn toward the pressure chamber, waiting until the drawn meniscus is returned in the vicinity of the nozzle orifice due to free vibration thereof; and driving the actuator so as to contract the pressure chamber so that the ink is ejected from the nozzle orifice after the waiting step is performed.

10. The driving method as set forth in claim 9, wherein a time period in which the waiting step is performed is roughly equal to a natural vibration period of ink stored in the pressure chamber.

11. A method of driving a recording head which includes a nozzle orifice, a pressure chamber communicated with the nozzle orifice, and an actuator associated with the pressure chamber, comprising the steps of:

driving the actuator so as to expand the pressure chamber so that meniscus of ink situated in the vicinity of the nozzle orifice is drawn toward the pressure chamber;

waiting until the drawn meniscus is returned in the vicinity of the nozzle orifice due to free vibration thereof; and driving the actuator so as to contract the pressure chamber so that the ink is ejected from the nozzle orifice after the waiting step is performed, wherein each of a time period in which the actuator is driven to expand the pressure chamber and a time period in which the waiting step is performed is approximately equal to a natural vibration period of ink stored in the pressure chamber.

* * * * *